US006545948B1

(12) United States Patent
Jiang

(10) Patent No.: US 6,545,948 B1
(45) Date of Patent: Apr. 8, 2003

(54) SUBMERSIBLE LOUDSPEAKER

(76) Inventor: Gejing Jiang, 860 E. 27th St., Apt. B11, Brooklyn, NY (US) 11210

( * ) Notice: Subject to any disclaimer, the term of this patent is extended or adjusted under 35 U.S.C. 154(b) by 0 days.

(21) Appl. No.: 09/455,831

(22) Filed: Dec. 6, 1999

(51) Int. Cl.[7] ..... H04R 1/44
(52) U.S. Cl. ..... 367/165
(58) Field of Search ..... 367/165, 173, 367/188, 172, 152, 141; 381/189

(56) References Cited

U.S. PATENT DOCUMENTS

| | | | | | |
|---|---|---|---|---|---|
| 3,073,916 | A | * | 1/1963 | Williams et al. | 381/189 |
| 4,100,527 | A | | 7/1978 | Tocquet | |
| 4,276,623 | A | | 6/1981 | Abbott | |
| 4,679,177 | A | | 7/1987 | Aoyagi et al. | |
| 4,782,471 | A | | 11/1988 | Klein | |
| 4,839,871 | A | | 6/1989 | Massey | |
| 4,920,523 | A | * | 4/1990 | Kruka et al. | 367/188 |
| 4,949,386 | A | * | 8/1990 | Hill | 381/189 |
| 5,012,457 | A | | 4/1991 | Mitchell et al. | |
| 5,103,432 | A | | 4/1992 | Percy | |
| 5,142,508 | A | | 8/1992 | Mitchell et al. | |
| 5,369,796 | A | | 11/1994 | Kung | |
| 5,406,153 | A | | 4/1995 | Flatau et al. | |
| 5,510,660 | A | | 4/1996 | Flatau et al. | |
| 6,172,940 | B1 | * | 1/2001 | McConnell et al. | 367/188 |

FOREIGN PATENT DOCUMENTS

| | | |
|---|---|---|
| CN | 2033174 | 2/1989 |
| CN | 2047871 | 11/1989 |
| CN | 2083373 | 8/1991 |

OTHER PUBLICATIONS

Thomas Abraham, Ph.D., "GB–064N Piezoelectric Ceramics, Ceramic/Polymer Composites and Polymers", pp. 1–2.
Department of Commerce, National Oceanic and Atmospheric Administration, Diving for Science and Technology, Section 5: Diver and Diving Equipment, 5.7 Underwater Communication Systems.
Ocean Engineering Enterprises Home Page, "Oceanears", Underwater Loudspeakers.
De Zhao, W. & Er Jie, S., (1981). 12.4 Sound Sources, Hydro–Listeners & Sound Base Array. Hydro–Acoustics, 686–688.

* cited by examiner

*Primary Examiner*—Daniel T. Pihulic
(74) *Attorney, Agent, or Firm*—Hedman & Costigan, P.C.

(57) ABSTRACT

A submersible loudspeaker including an electro-acoustic transducer which accepts the electrical signal from the audio system and delivers sound waves generated by piezoelectric elements in proportion to the signal applied to it. The speaker primarily comprises at least one transformer operatively connected to a piezoelectric ceramic element to form a sound element array, contained within a waterproof sealing body comprising a diaphragm for transducing sound waves to the receiving medium, and encased within a shell or housing. The piezoelectric element is in contact with the diaphragm that directly contacts the transfer medium. The submersible loudspeaker is designed to be used in swimming pools, spas, hot tubs, bathtubs, saunas, ponds, lakes or other bodies of water. A system would include a submersible loudspeaker used in conjunction with an air speaker on a single audio output system, so that a listener can simultaneously listen to music underwater and in the surrounding air.

28 Claims, 8 Drawing Sheets

SUBMERSIBLE LOUDSPEAKER

BACKGROUND OF THE INVENTION

1. Technical Field

The present invention relates to a loudspeaker that is designed to be submersible in a liquid medium, or used in a high humidity environment, more particularly a medium that contains water.

2. Description of the Related Art

It has been found desirable to have speakers in high humidity environments, such as indoor pools, spas and saunas. It has also been found desirable to have speakers which are submersible, so that, for instance, swimmers can listen to music or receive coaching while underwater.

Submersible speakers have been previously attempted, however a simple dependable design has not been found. For example, the Chinese Patent Application number 88,211,595.2 to Shanghai Acoustics Lab, relates to an underwater loudspeaker which uses a soft edge propping structure and a bending vibration type piezoelectric ceramic element.

Another example is Chinese Patent Application number 89,211,484.3, also to Shanghai Acoustics Lab on an all sealed plastic housing structure and a transformer being molded as a whole body.

A third example is Chinese Patent Application number 90,207,368.0, again to Shanghai Acoustics Lab. The device described therein contains an elastic metal chip with a piezoelectric element to form a bending vibration type sound element.

These prior art references, however, are complex designs and therefore are deficient in providing a submersible speaker which is both dependable while simple in design.

SUMMARY OF THE INVENTION

The object of the present invention is to provide a system, particularly a loudspeaker, which enables audio signals to be transmitted into an array of receiving mediums, particularly air, high humidity air, water and salt water. This loudspeaker accepts electrical signals from an audio system and delivers sound waves generated by its piezoelectric crystals in proportion to the signal applied to it; which are connected in either series or in parallel to (an) impedance matching transformer(s) also connected in series or in parallel.

One objective of the invention is to enable a listener to hear audio signals under a body of water, i.e. a swimming pool, a spa, a hot tub, a pond, lake, etc.

Another objective is to enable a listener to hear audio signals through a receiving medium such as air including air with a high humidity level, as in a sauna.

Still another objective is to enable a listener to hear simultaneously, the same audio signals through multiple receiving mediums, so that a listener can enjoy the audio signals when transferring from one medium to another.

These and other objectives of the invention will become more readily apparent from the ensuing specification and the claims when taken with the accompanying drawings, and are achieved by the present claimed invention directed to a submersible loudspeaker comprising a sound element array, and a sealing body providing a means of waterproofing the sound clement array, the sealing body comprising a diaphragm for transducing sound waves into a receiving medium. Preferably the sealing body is encased in a Lousing providing a means for protecting said sealing body as well as the sound element array therein.

The sound element array preferably includes at least one transformer and a piezoelectric ceramic element, laving a ceramic chip on one side and a metal chip on the other, operatively connected to generate sound waves in response to an audio signal supply. The metal chip of the piezoelectric element contacts the diaphragm of the sealing body which in turn transduces sound waves into the receiving medium.

The diaphragm can be formed integral with the sealing body or can be a separate element provided that a watertight environment is maintained within the sealing body. It is most preferred, however, that the diaphragm be formed of a flexible material, such as rubber, laving a density close to that of water.

BRIEF DESCRIPTION OF THE DRAWINGS

The attached drawings, in which like characters represent like parts, are intended solely to illustrate the present invention without limiting the invention in any manner whatsoever, wherein.

DETAILED DESCRIPTION OF THE INVENTION

Figure 1B:
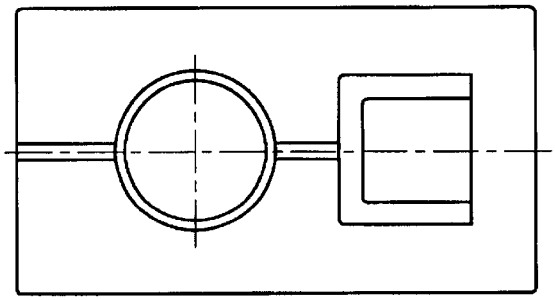
FIG. 1B is a cross-sectional front view of the preferred submersible speaker of FIG. 1A.
Figure 1A:
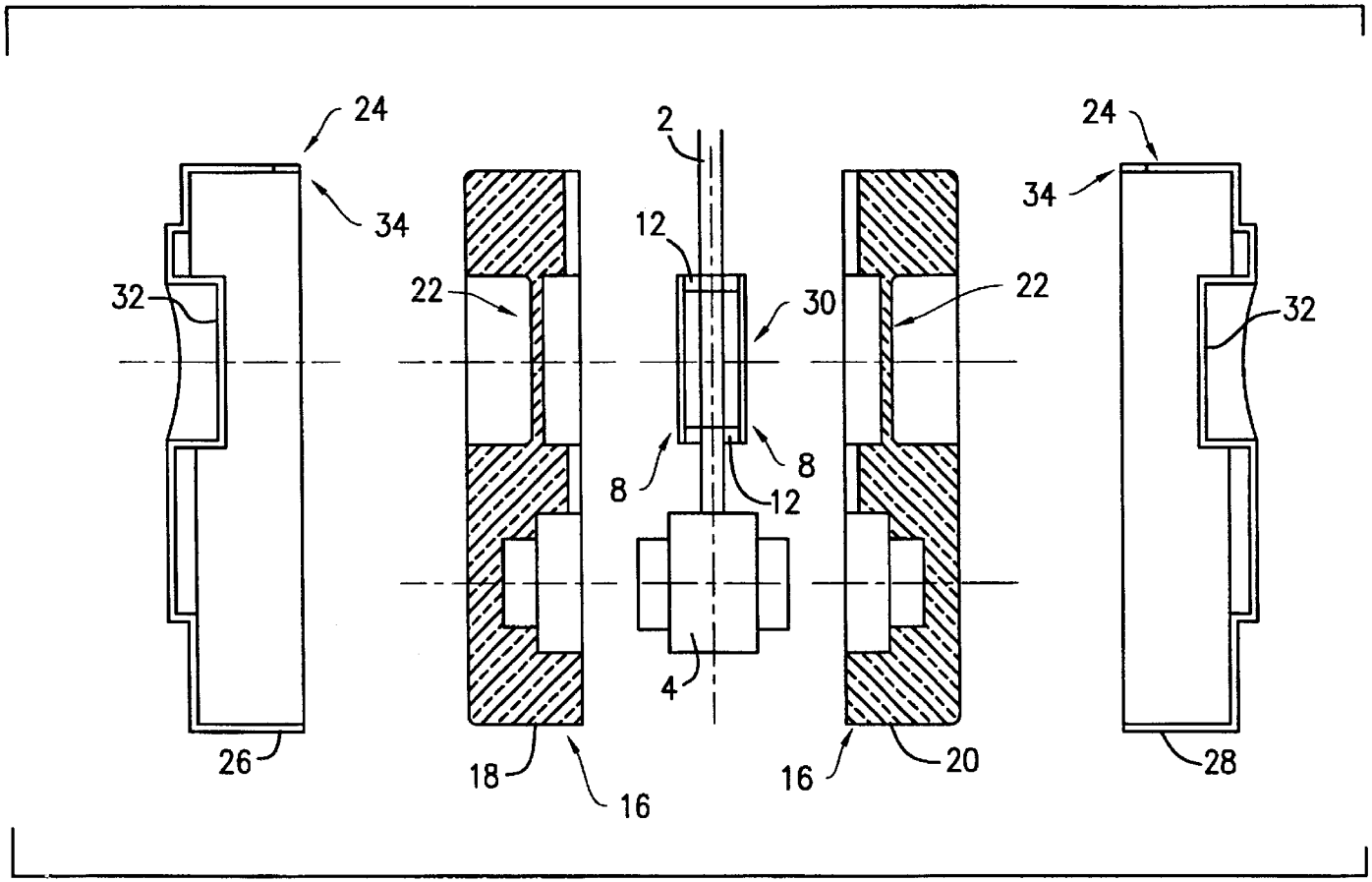
FIG. 1A is an exploded side view of the preferred submersible speaker of the present invention.
Figure 2B:
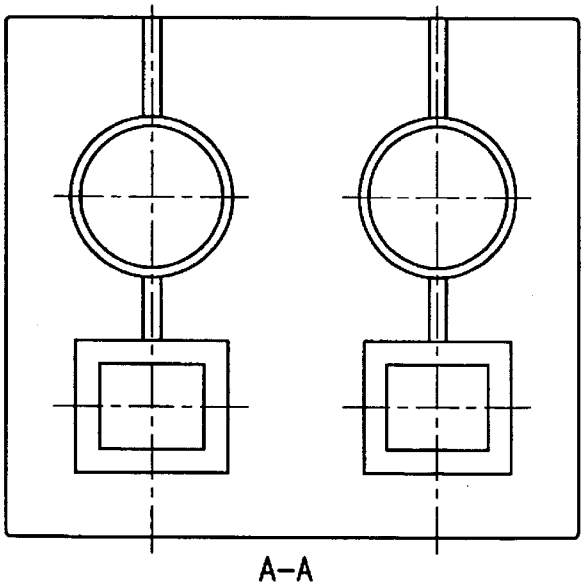
FIG. 2B is a cross-sectional front view of the speaker of FIG. 2A of the present invention.
Figure 2A:
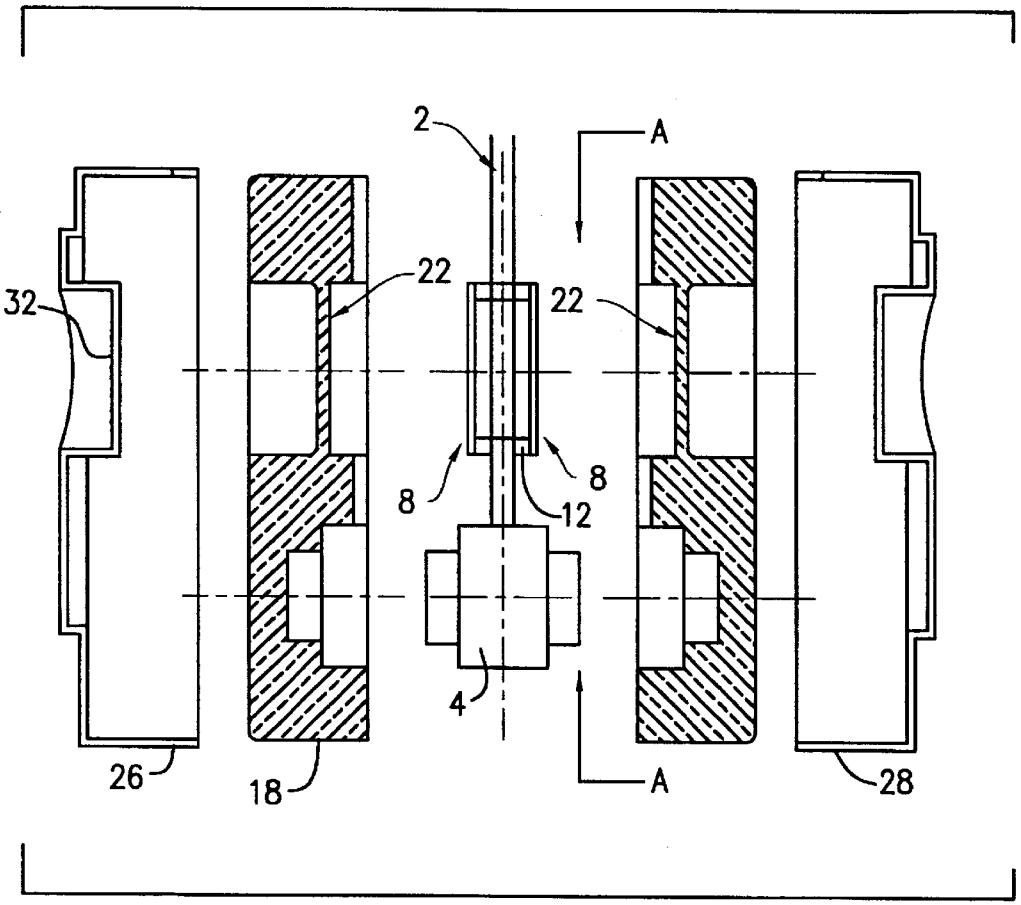
FIG. 2A is an exploded side view of an alternative submersible speaker of the present invention.

Referring now to the drawings of the loudspeaker system, and particularly FIG. 1, audio signals are supplied to a transformer 4 by an audio signal supply means 2. The audio signals are then transmitted by the transformer 4 to the piezoelectric elements 8 by an electronic signal connection 6. The sound element array 30, including the transformer 4 and the piezoelectric elements 8, is sealed in a waterproof environment by a sealing body 16 which includes a diaphragm 22. Preferably the sealing body 16 is encased within a shell or housing 24. Finally, once the assembly is enclosed within the sealing body 16, the loudspeaker system can be submersed, and used in conjunction with an audio output or audio supplier.

In the preferred embodiment, an audio signal is supplied to a transformer 4 via an audio signal supply means 2, preferably a cable, more preferably a cable having a copper core of about 3–5 mm, and most preferably a RCA cable having standard RCA jacks, which is capable of withstanding exposure up to at least 80° C. (176° F.). When using a cable or wire, the cable or wire should have a limiting means 34 where it enters into the housing 24, so that a force exerted on the cable or wire can be transferred to the housing 24, while preventing the cable or wire from becoming disconnected from the transformer 4 or broken. Moreover the collar 34 can be affixed to the housing 24 for improved waterproofing, preferably with an adhesive.

The audio signals are transmitted by said transformer 4, is preferably a step up transformer, more preferably a step up transformer that is rated to about 10 watts of power, an iron core section area which is about 1.6×2.3 $cm^2$, and having a ratio winding of about 1:10. The transformer 4 includes at least a primary and secondary winding. The primary winding preferably has about 88 windings of wire, preferably an enameled wire of about 0.5 mm diameter, and a secondary winding having about 880–1,000 windings of wire, preferably an enameled wire of about 0.2–0.25 mm wire diameter, where the primary winding has an impedance of about 8 ohms when connected to an audio system.

The transformer 4 is connected in either series or in parallel, preferably in parallel, to at least one piezoelectric ceramic element 8, by an electronic signal connection 6, preferably a wire or cable. In its most preferred embodiment, at least one pair of piezoelectric elements 8 are connected to a transformer 4. The piezoelectric ceramic elements 8 preferably have a resonance frequency of about 2.5–3.0 KHz, a capacitance of about 55,000±30% PF, and an equivalent resistance of ≦350 ohms, noting that each piezoelectric ceramic element 8 comprises a ceramic chip 10, and a metal chip 12 on opposing sides. The piezoelectric ceramic element has an overall thickness of about 0.4 mm±0.1 mm. The ceramic chip 10 preferably Las the characteristics of a diameter of about 30 mm, with a thickness of about 0.2 mm, while the metal chip 12 has the characteristics of a diameter of about 50 mm, with a thickness of about 0.15 mm.

An insulated bushing 14 is affixed to and between said piezoelectric ceramic elements 8 when at least one pair of piezoelectric elements 8 are used. In such embodiment, the piezoelectric elements 8 are oriented with the metal chips 12 facing away from each other, and said ceramic chips 10 towards each other, within said sound element array 30. The insulated bushing 14 can be any suitable size, most preferably having the characteristics of a length of about 27.6 mm, an outside diameter of about 50 mm and an inside diameter of about 44–46 mm in this embodiment.

The electronic signal connection 6, can be connected by either passing through or around said insulated bushing 14. Hence, a preferred sound element array 30 comprises at least one pair of piezoelectric ceramic elements 8 connected by an electronic signal connection 6 to at least one transformer 4, which is connected to an audio signal supply means 2, preferably having a resonance frequency of about 2,800 Hz, and an impedance of about 490 ohms.

The sound element array 30 is encased in a sealing body 16, preferably a pair of sealing body sections comprising a first half body 18 and a second half body 20. The respective halves 18 and 20 should have a diaphragm 22, for each piezoelectric element. The sealing body 16 is made from a material that provides a means for keeping said sound element array 30 dry, incorporating one or more diaphragms 22 for transmitting sound into a receiving medium. The sealing body 16 and the diaphragm 22 further have the characteristics of a nonmetal, insulating material. When the diaphragm 22 is formed integral formed with the sealing body 16, the sealing body 16 is preferably made of a material having the characteristics of rubber. Notwithstanding, the diaphragm has a thickness of about 1.2 mm, a density about the same as the said receiving medium, preferably water, an internal surface that contacts said metal chips 12, an external surface that contacts said receiving medium, preferably water, and which is transparent to acoustic waves. The required thickness of the diaphragm 22 should be considered a function of the temperature of the receiving medium as well as the duration at that temperature. For example, in an underwater spa environment, a thicker diaphragm 22 may be preferred for a longer life expectancy.

In its preferred embodiment, the sealing body 16 has a first half 18 and a second half 20 which are affixed together with an adhesive, preferably an epoxy resin to ensure a waterproof environment in the interior. Also it is understood that the sealing body can comprise a unibody made by a method selected from the group consisting of pouring and injection moulding.

Figure 5:
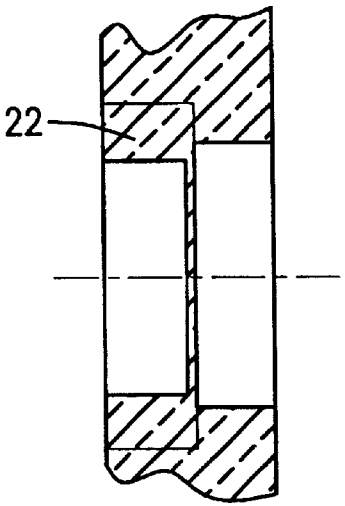
FIG. 5 is a partial cross-sectional side view of an alternative embodiment of the diaphragm portion of the sealing body, where the diaphragm is not formed integrally with the sealing body.

It is most preferred that the diaphragm 22 is integrally formed with the sealing body 16. Alternatively, the diaphragm 22 can be a separate and distinct element as shown in FIG. 5. If the alternative embodiment is selected, the diaphragm 22 must be afixed to the sealing body 16 to ensure a waterproof seal. This can be achieved by any known means, preferably, however an adhesive or compression type attachment including the use of a threaded plug or gasket, alone or in combination.

Once the sealing body 16 has been completed to provide a waterproof environment for the sound element array 30 therein, it is encased in a housing 24. The housing 24 is made from a material consisting of a metal or a non-metal, more preferably a plastic and most preferably ABS plastic. The housing 24 comprises a first half housing 26 and a second half housing 28 each having an opening corresponding to the location of each diaphragm 22, which is preferably covered with a grille 32, see FIG. 4B. Said first half housing 26 and said second half housing 28 are affixed together by any known means and preferably with a snap fit, cooperating screws and holes, latches, adhesives and any combination, to form said housing 24, as shown in FIG. 4B.

Figure 4B:
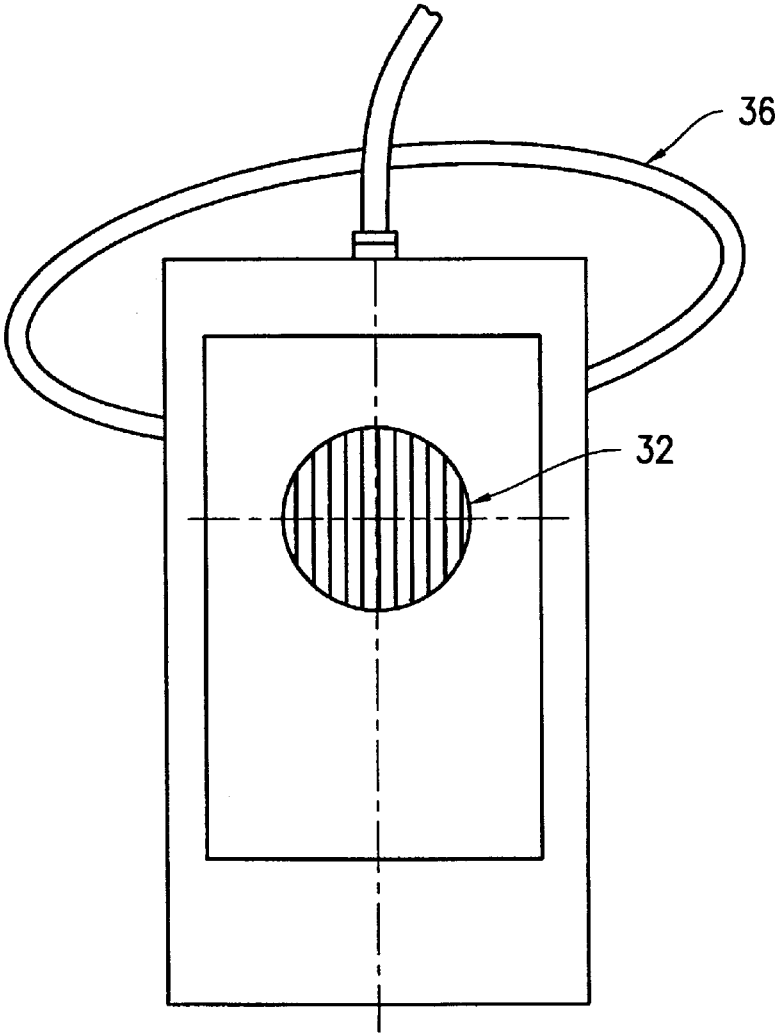
FIG. 4B is a front view of the fully assembled submersible speaker of FIG. 1A, with strapping means.
Figure 4A:
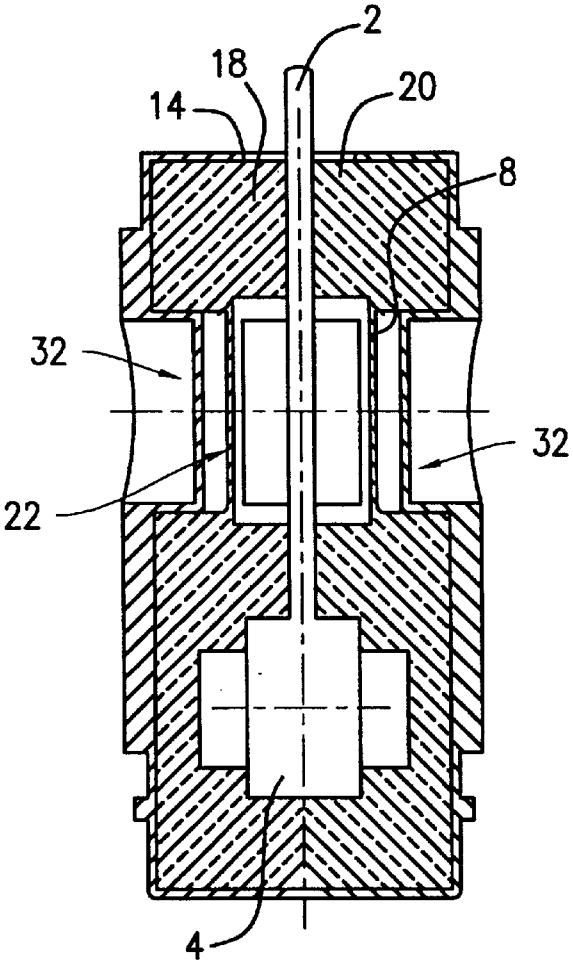
FIG. 4A is a cross-sectional side view of the fully assembled submersible speaker of FIG. 1A.
Figure 6:
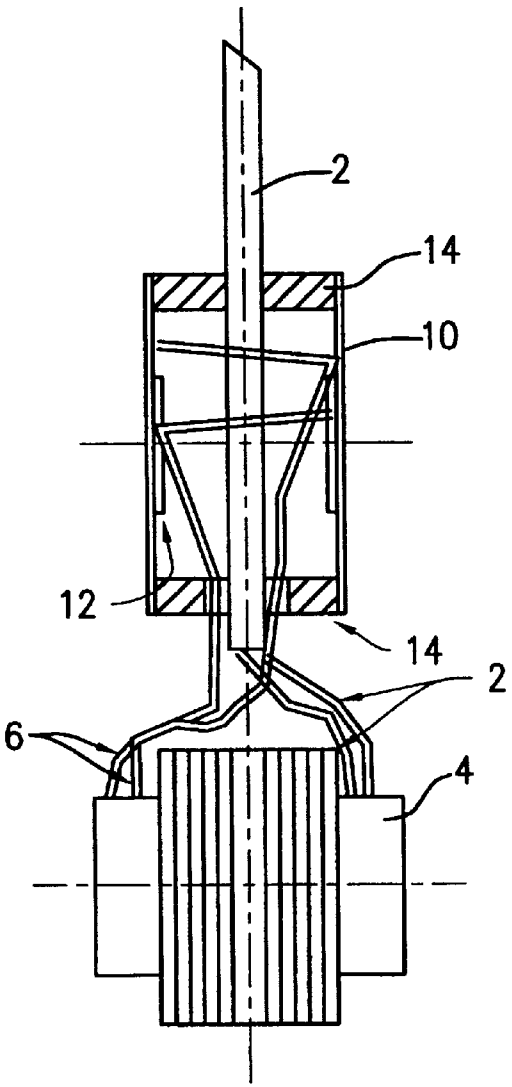
FIG. 6 is a cross-sectional view of the preferred sound element array.

The housing as shown in FIG. 4B, also provides a strapping means 36, which is affixed to the housing 24 to provide a means for supporting, hanging, carrying or mounting the submersible loudspeaker.

Any adhesive used in the production and assembly of this submersible loudspeaker, generally essential to waterproof the sealing body 16, must have the characteristics of a fast curable adhesive, preferably based on epoxy resin. The preferred epoxy resin has the following characteristics: a tensile strength of greater than about 850 kg/cm$^2$, a compression strength of greater than about 280 kg/cm$^2$, and a curing time of about 4–8 hours, preferably 6–8 hours. However, it is understood that any suitable water resistant bond is acceptable, including heat sealing, ultrasonic welding, etc., or any combination thereof. Once the adhesive has cured, the submersible loudspeaker system is ready for use.

Figure 11:
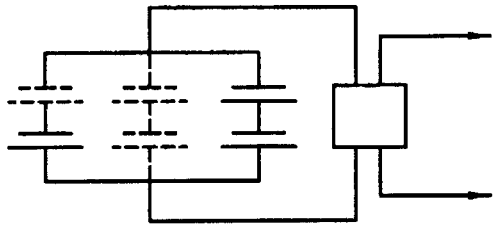
FIG. 11 is a schematic of an alternative wiring diagram for the present invention with an alternative combination of array elements.
Figure 8:
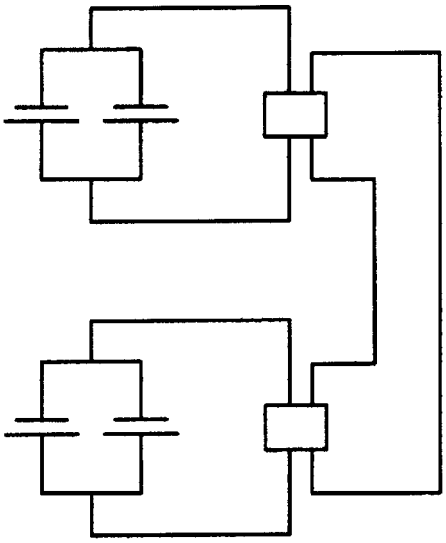
FIG. 8 is a schematic of an alternative wiring diagram for the present invention as shown in FIG. 2A.
Figure 10:
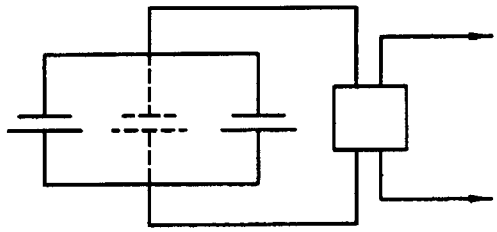
FIG. 10 is a schematic of an alternative wiring diagram for the present invention as shown in FIG. 1A.
Figure 7:
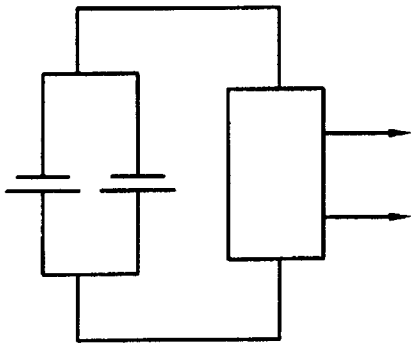
FIG. 7 is a schematic of a preferred wiring diagram for the present invention as shown in FIG. 1A.
Figure 9:
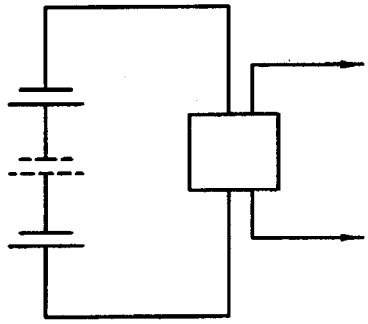
FIG. 9 is a schematic of an alternative wiring diagram for the present invention as shown in FIG. 1A.
Figure 13:
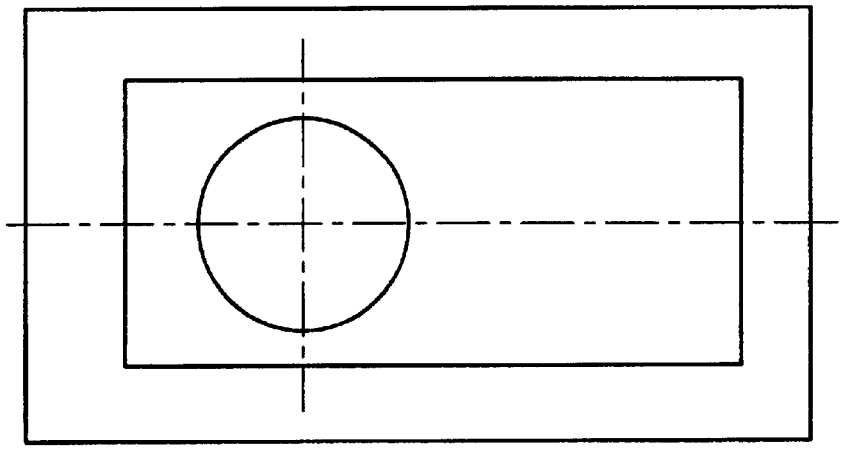
FIG. 13 is a front view of a housing for the sealing body of FIG. 12.
Figure 12B:
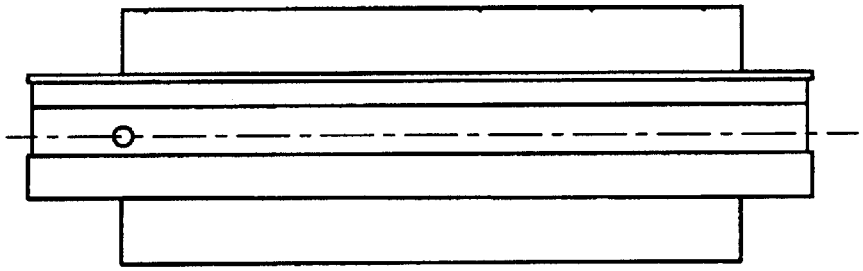
FIG. 12B is a side view of the sealing body of FIG. 12A.
Figure 12A:
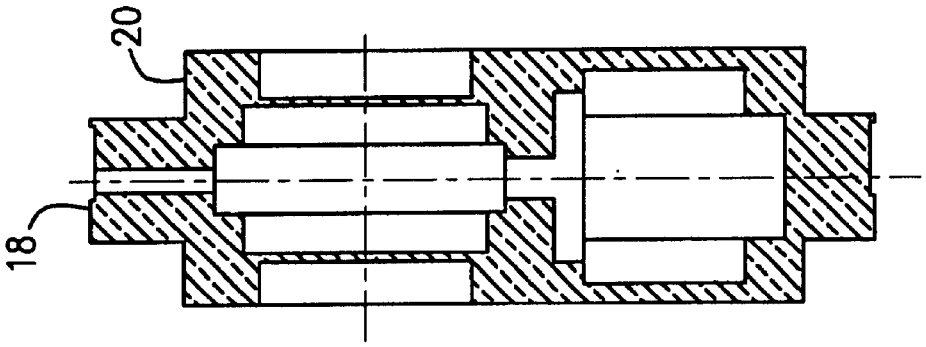
FIG. 12A is a cross-sectional side view of the interlocking halves of the sealing body, in their sealed relationship.

Other embodiments include the use of transformers 4 with piezoelectric elements 8 invarious combinations, examples of which are shown in FIGS. 7 through 11. Alternative embodiments include connecting the transformer 4 in parallel with one pair of piezoelectric elements 8 as in FIG. 7. A multiple of the embodiment of FIG. 7 wherein two configurations are attached in parallel to the audio output or audio supplier is shown in FIG. 8. Additionally, connecting the transformer 4 with three pair of piezoelectric elements 8 is shown in FIG. 10. Other embodiments include connecting a transformer 4 in series with three piezoelectric elements 8 as shown in FIG. 9, or even two piezoelectric elements 8 connected in series forming a pair, so that the three pair of piezoelectric elements 8 are connected in parallel to a single transformer 4, as shown in FIG. 11.

Figure 3B:
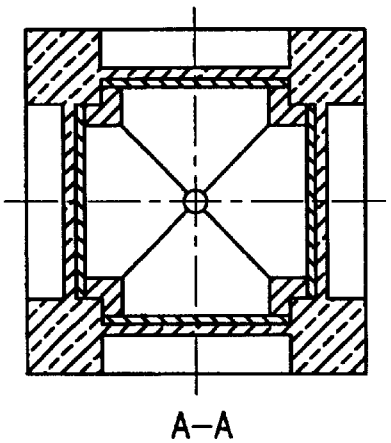
FIG. 3B is a cross-sectional top view of the speaker of FIG. 3A having a diaphragm on four sides.
Figure 3A:
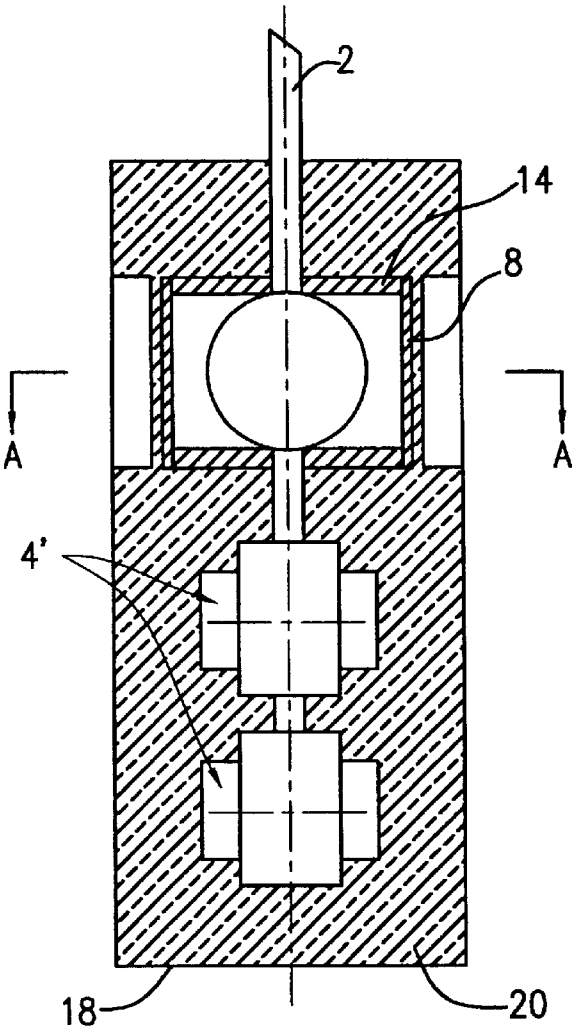
FIG. 3A is a cross-sectional side view of an alternative submersible speaker.

Still another includes the use of two transformers 4 connected in parallel, with two pair of piezoelectric elements 8 as shown in FIG. 3A and FIG. 3B.

It is also anticipated that the present invention may include the simultaneous use of at least one speaker in dry air, with another in high-humidity air, and still another in a pool. Thus, a potential listener can move from one receiving medium to another without missing a beat.

Figure 14D:
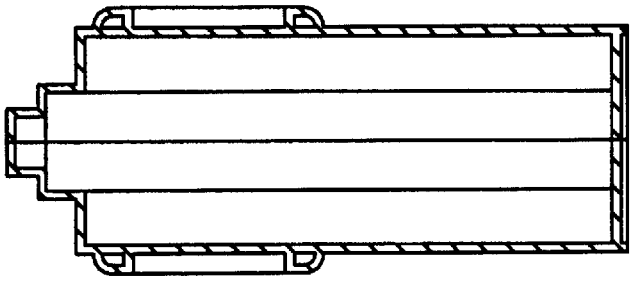
FIG. 14D is a cross-sectional side view of the housing of the speaker of FIG. 14A.
Figure 14C:
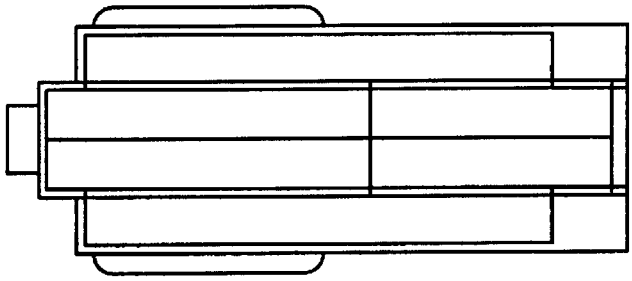
FIG. 14C is a ode view of the speaker of FIG. 14A.
Figure 14B:
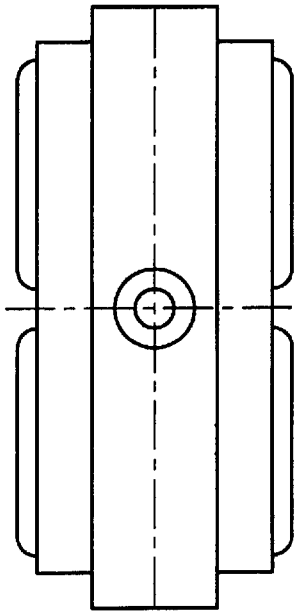
FIG. 14B is a top view of the speaker of FIG. 14A.
Figure 14A:
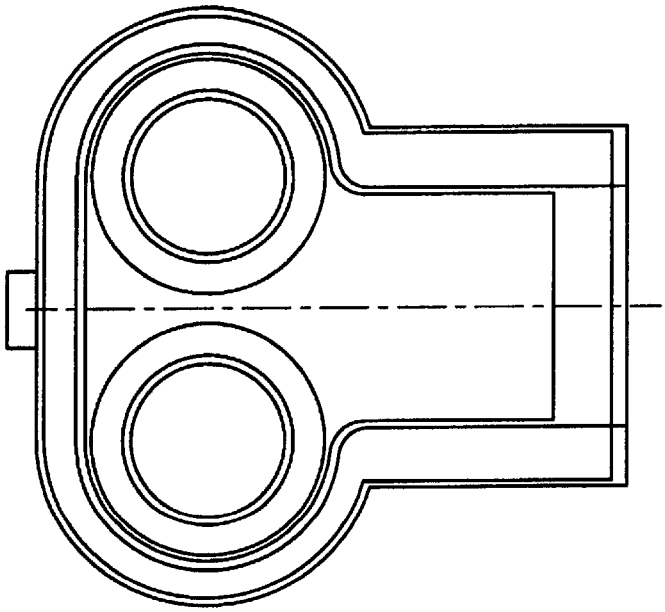
FIG. 14A is front view of another alternative embodiment, wherein the submersible loudspeaker has two pair of piezoelectric elements.

Of course, variations and modifications to the described embodiment will make themselves apparent to one skilled in the art reading the disclosure, and FIGS. 1 through 14D. For example, the audio signal supply means 2 can be a cable, speaker wire, fiber optic, s-cable, RF transmitter/receiver or other known means. Another example includes a housing 24 for two pair of piezoelectric elements 8 is shown in FIG. 14A. All such variations and modifications are intended to fall within the spirit and scope of the present invention limited only by the appended claims. All patents and publications referred to herein are incorporated by reference.

What is claimed is:

1. A submersible loudspeaker comprising:

a sound element array; and a sealing body providing a means of waterproofing said sound element array, said sealing body comprising a diaphragm for transducing sound waves into a receiving medium; wherein said sealing body comprises a unibody made by a method selected from the group consisting of pouring and injection molding the material about said sound element array.

2. A submersible loudspeaker comprising:

a sound element array; and a sealing body providing a means of waterproofing said sound element array, said sealing body comprising a diaphragm for transducing sound waves into a receiving medium; wherein said diaphragm is made of material that provides a means for transmitting sound into a receiving medium wherein said material:

a. is a nonmetal, insulating material;

b. has a thickness of about 1.2 mm;

c. has a density about the same as the medium in which the speaker is submerged; and d. is transparent to acoustic waves.

3. A submersible loudspeaker comprising:

a sound element array; and a sealing body providing a means of waterproofing said sound element array, said sealing body comprising a diaphragm for transducing sound waves into a receiving medium; wherein the sound element array comprises:

a. at least one transformer;

b. at least one piezoelectric ceramic element, each having a ceramic chip and a metal chip on opposing sides, oriented with said metal chip contacting said diaphragm;

c. an audio signal supply means operatively connected to the at least one transformer providing a means for receiving an audio output; and d. an electronic signal connection operatively connecting said transformer to said piezoelectric element.

4. The submersible loudspeaker as defined in claim 3, wherein said sealing body comprises at least two sections affixed together about said sound element array.

5. The submersible loudspeaker as defined in claim 3, wherein said sound element array further comprises at least one pair of piezoelectric elements and an insulated bushing having at least two sides, said hushing affixed intermediate said ceramic chips of said pair of piezoelectric elements.

6. The submersible loudspeaker as defined in claim 3, wherein each of said at least one transformer is operatively connected to a pair of piezoelectric elements.

7. The submersible loudspeaker as defined in claim 6, wherein said pair of piezoelectric elements are orientated with the metal chips facing outwardly.

8. The submersible loudspeaker as defined in claim 3, wherein said diaphragm is formed separately from said sealing body.

9. The submersible loudspeaker as defined in claim 3, wherein said diaphragm is formed integral with said sealing body.

10. The submersible loudspeaker as defined in claim 8, wherein said diaphragm is operatively connected to said sealing body.

11. The submersible loudspeaker as defined in claim 3, wherein said electronic signal connection is selected from the group consisting of cable, speaker wire, fiber optic, and s-cable.

12. An submersible loudspeaker as in claim 3, wherein said transformer is rated to about 10 Watts of power.

13. A submersible loudspeaker comprising:

a sound element array; and a sealing body providing a means of waterproofing said sound element array, said sealing body comprising a diaphragm for transducing sound waves into a receiving medium; wherein said sealing body comprises at least two sections affixed together about said sound element array by a waterproof adhesive.

14. The submersible loudspeaker as defined in claim 13, wherein said housing is made from plastic.

15. The submersible loudspeaker as defined in claim 13, wherein said housing is made from a non-metal material.

16. The submersible loudspeaker as defined in claim 13, further comprising a housing about said sealing body, said housing comprising an opening arranged in an area corresponding to said diaphragm.

17. The submersible loudspeaker as defined in claim 13, wherein said diaphragm is operatively connected to said sealing body.

18. The submersible loudspeaker as defined in claim 13, wherein said diaphragm is formed integral with said sealing body.

19. The submersible loudspeaker as defined in claim 13, wherein said adhesive is an epoxy resin.

20. The submersible loudspeaker as defined in claim 13, wherein said diaphragm is formed separately from said sealing body.

21. A submersible loudspeaker comprising:

a sound element array; and a sealing body providing a means of waterproofing said sound element array, said sealing body comprising a diaphragm for transducing sound waves into a receiving medium; and a strap for supporting the speaker.

22. A submersible loudspeaker comprising:

a sound element array; and a sealing body providing a means of waterproofing said sound element array, said sealing body comprising a diaphragm for transducing sound waves into a receiving medium; wherein said sealing body comprises at least two interlocking sections affixed together about said sound element array.

23. The submersible loudspeaker as defined in claim 22, wherein said housing is made from plastic.

24. The submersible loudspeaker as defined in claim 22, wherein said housing is made from a non-metal material.

25. The submersible loudspeaker as defined in claim 22, further comprising a housing about said sealing body, said housing comprising an opening arranged in an area corresponding to said diaphragm.

26. The submersible loudspeaker as defined in claim 22, wherein said diaphragm is operatively connected to said sealing body.

27. The submersible loudspeaker as defined in claim 22, wherein said diaphragm is formed integral with said sealing body.

28. The submersible loudspeaker as defined in claim 22, wherein said diaphragm is formed separately from said sealing body.

* * * * *